United States Patent [19]

Washizu

[11] Patent Number: 5,058,409

[45] Date of Patent: Oct. 22, 1991

[54] APPARATUS FOR MANUFACTURING WRINKLED PIPES

[75] Inventor: Katsushi Washizu, Numazu, Japan

[73] Assignee: Usui Kokusai Sangyo Kaisha Limited, Japan

[21] Appl. No.: 593,804

[22] Filed: Oct. 5, 1990

[30] Foreign Application Priority Data

Oct. 13, 1989 [JP] Japan ..... 1-267105

[51] Int. Cl.[5] ..... B21D 15/06

[52] U.S. Cl. ..... 72/59; 72/370

[58] Field of Search ..... 72/59, 58, 370, 60

[56] References Cited

U.S. PATENT DOCUMENTS

| | | | |
|---|---|---|---|
| 2,581,787 | 1/1952 | Dreyer | 72/59 |
| 2,954,064 | 9/1960 | De Mers | 72/59 |
| 3,067,744 | 12/1962 | Cooper et al. | 72/59 |
| 3,083,754 | 4/1963 | De Mers | 72/59 |
| 3,130,771 | 4/1964 | Peyton | 72/59 |
| 3,339,386 | 9/1967 | Homfeldt | 72/59 |
| 3,375,689 | 4/1968 | Millar | 72/59 |
| 4,364,252 | 12/1982 | Koizumi | 72/59 |

FOREIGN PATENT DOCUMENTS

| | | | |
|---|---|---|---|
| 0532335 | 10/1956 | Canada | 72/59 |

*Primary Examiner*—Lowell A. Larson
*Assistant Examiner*—Michael J. McKeon
*Attorney, Agent, or Firm*—Anthony J. Casella; Gerald E. Hespos

[57] ABSTRACT

Herein disclosed is a wrinkled pipe manufacturing apparatus in which an elastic member is inserted into a pipe to be worked and is pushed from at least one side so that it may be radially bulged to form an annular bulge on the circumference of the pipe and in which a punch and a chuck disposed around the circumference of the pipe are axially moved relative to each other to form a wrinkle from the annular bulge. The apparatus comprises: first and second mandrels held over a bed to move freely in the axial directions along the upper face of the bed and adapted to bear the pipe on their circumferences; first drive means for driving the mandrels in the axial directions; an elastic member arranged in the pipe and between the leading end faces of the first and second mandrels; second drive means for moving a punch and a chuck; and guide means for guiding the chuck and the punch in the axial directions on a concentric plane of the axis.

1 Claim, 7 Drawing Sheets

APPARATUS FOR MANUFACTURING WRINKLED PIPES

BACKGROUND OF THE INVENTION

1. Field of the Invention

The present invention relates to an apparatus for manufacturing a wrinkled pipe having a highly accurate external diameter and, more particularly, to a wrinkled pipe manufacturing apparatus capable of manufacturing a highly accurate wrinkled pipe having no rise of the curled end portion even if the pipe is a curled pipe of multiple layers.

2. Description of the Prior Art

The wrinkled pipe manufacturing apparatus has been proposed in Japanese Patent Publication No. 44-24746 (Bulging Apparatus), Japanese Patent Laid-Open No. 59-133021 (Method of and Apparatus for Manufacturing Strung Pipe) or Japanese Patent Laid-Open No. 63-207421 (Method of and Apparatus for Manufacturing Beaded Pipe).

Of these, the proposal of Japanese Patent Publication No. 44-24746 works and shapes the necessary wrinkled portion by one step of performing the bulging of the beaded portion due to an internal pressure and the axial compression by a mold simultaneously.

According to the proposal of Japanese Patent Laid-Open No. 59-133021, the strung pipe is manufactured by inserting two mandrel rods interposing an elastic member into a pipe, by pushing one of the mandrel rods toward the other to deform the elastic member thereby to pull and bulge a portion of the pipe, and then by shaping the bulged portion in conformity with a bending mold receiving the bulged portion.

According to the proposal of Japanese Patent Laid-Open No. 63-207421, on the other hand, the beaded pipe is manufactured by arranging a pressure medium for applying an internal pressure to the inside of a work, by arranging molding elements having a bead shaping recess outside of the work for relatively moving toward and apart from the pipe axis, and by plastically deforming the work into the bulged state to move the molding elements toward each other.

Of the systems thus far described according to the prior art, the proposal of Japanese Patent Laid-Open No. 44-24746 is required to prepare its mold according to the length of the pipe and the beam number of the wrinkles, to have its workable pipe length restricted and to have an expensive mold.

Both the proposals of Japanese Patent Laid-Open Nos. 59-133021 and 63-207421 can have a relatively high degree of freedom in the beat number of wrinkles but has its elastic member extending through the mandrels. In order to retain the strength of the mandrels and the space for the elastic member, the mandrel portions are so difficult to thin that the diameter of the workable pipe is about 16 mm at the least.

Since, moreover, the molding portions have the bead shaping grooves, the external diameter and pitch of the beads are restricted to limit the degree of freedom for the bead shape. Since, moreover, the pipe is fixed at its bulging two ends by the mold, it cannot move sufficient in the axial directions during its bulging operations so that the bead ridge is thinned whereas the elastic member is forced to slide and is seriously worn. Since the elastic member will bulge into the mold of the two proposals, the mold is required to have a high molding force so that the elastic member is subject to an excessive force and will be worn.

When the wrinkles are to be continuously molded, the elastic member is compressed from the wrinkle side to bite into the gaps of the wrinkles so that it is seriously worn.

According to the proposal of Japanese Patent Laid-Open No. 63-207421, moreover, the bulging portion is axially compressed together with the elastic member to cause a trouble that the elastic member is torn to pieces.

SUMMARY OF THE INVENTION

The present invention has been conceived in view of the aforementioned stage of the manufacture of the wrinkled pipe and has an object to provide a wrinkled pipe manufacturing apparatus which can form both a multi-layered wrinkled pipe without any separation of the outermost layer end portion and a highly accurate wrinkled pipe having a diameter as small as about 16 mm by freely setting the external diameter and the pitch.

In order to achieve the above-specified object, according to the present invention, there is provided a wrinkled pipe manufacturing apparatus in which an elastic member is inserted into a pipe to be worked and is pushed from at least one side so that it may be radially bulged to form an annular bulge on the circumference of said pipe and in which a punch and a chuck disposed around the circumference of said pipe are axially moved relative to each other to form a wrinkle from said annular bulge, wherein the improvement comprising: first and second mandrels held over a bed to move freely in the axial directions along the upper face of said bed and adapted to bear said pipe on their circumferences; first drive means for driving said mandrels in said axial directions; an elastic member arranged in said pipe and between the leading end faces of said first and second mandrels; second drive means for moving a punch and a chuck; and guide means for guiding said chuck and said punch in said axial directions on a concentric plane of said axis.

In the present invention, the pipe to be worked is loosely borne on the outer circumferences of the first and second mandrels, and the elastic member is interposed in the pipe between the opposed end faces of the first and second mandrels.

By actuating the first drive means in that state, the elastic member is bulged radially of the pipe to form the annular bulge on the circumference of the pipe at a first step.

Next, the second drive means is actuated to move the punch and the chuck to form a wrinkle from the annular bulge formed on the pipe circumference at a second step. The wrinkle thus shaped is clamped by the chuck, and the pipe is moved to a predetermined position at a third step.

Moreover, the pipe thus moved is repeatedly subjected to the first to third steps so that the wrinkles are continuously formed at a predetermined interval on the pipe.

Since the chuck and the punch are guided on a concentric plane of the axis by the guide means and are coaxially moved highly accurately, it is possible to manufacture a thin wrinkled pipe of high quality. Since, moreover, the pipe has its outer circumference pushed by the guide means, the wrinkles obtained have a highly accurate external diameter. In case the pipe is a multi-layered one, its outermost layer does not have its end portion separated.

DETAILED DESCRIPTION OF THE PREFERRED EMBODIMENTS

The present invention will be described in detail in the following in connection with the embodiments thereof with reference to the accompanying drawings.

First of all, an embodiment of an apparatus for manufacturing a wrinkled pipe according to the present invention will be described with reference to FIGS. 1 and 2.

Figure 1:
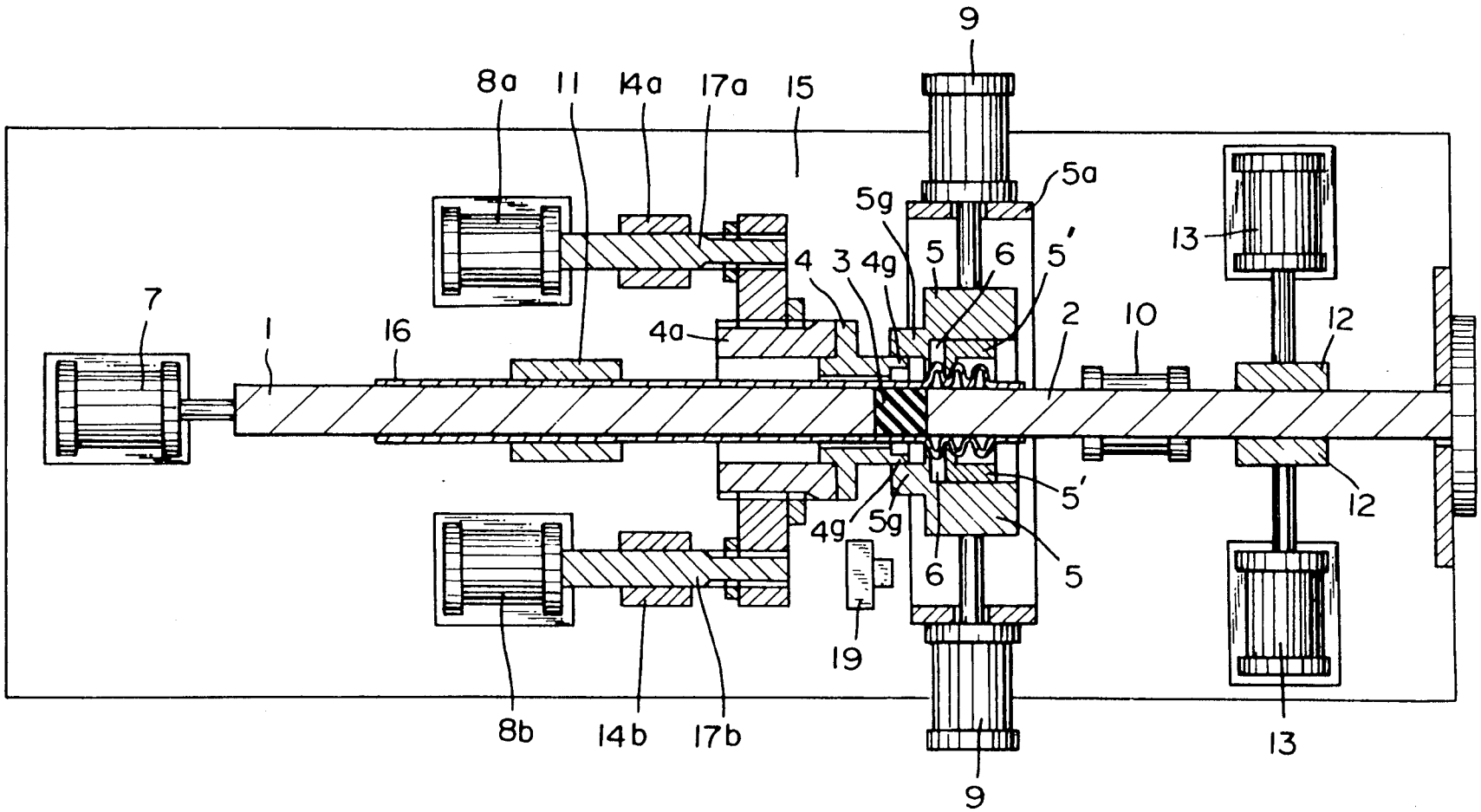
FIG. 1 is a top plan view showing the structure of an embodiment of the present invention partially in section.
Figure 2:
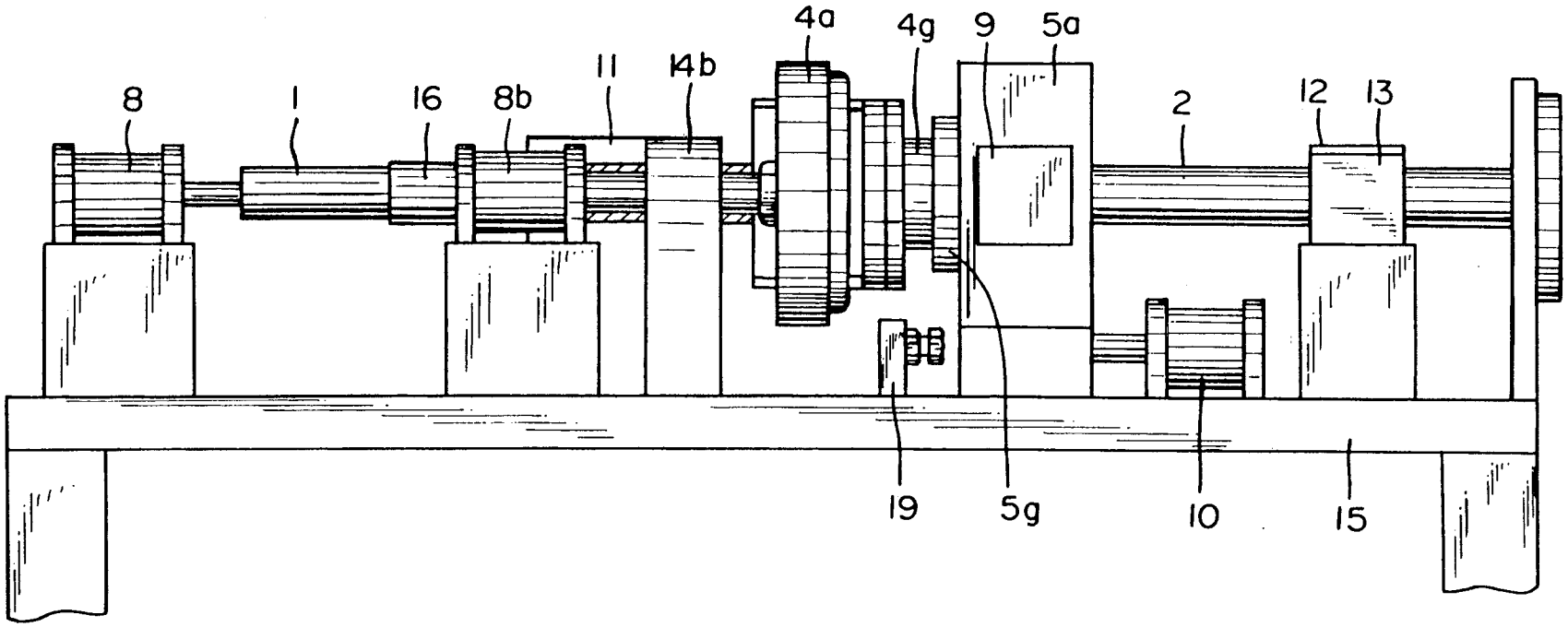
FIG. 2 is a front elevation showing the structure of the embodiment of the present invention of FIG. 1.

Here, FIG. 1 is a top plan view showing the structure of the embodiment partially in section; and FIG. 2 is a front elevation showing the structure of the embodiment of FIG. 1.

The embodiment corresponds to the case in which an elastic member arranged in a pipe to be worked is pushed from one side. On the end portion of a bed 15, there is fixed a mandrel driving cylinder 7 for driving a first mandrel 1 forward and backward in the axial direction. This first mandrel 1 is held and arranged with respect to the bed 15 so that a pipe 16 to be worked may be freely born on the circumference of the cylinder 7.

In the pipe 16 borne freely on the first mandrel 1, there is arranged an elastic member 3 which has its one end face abutting against the leading end face of the first mandrel 1. In the pipe 16, there is also inserted a second mandrel 2 which is arranged concentrically with the first mandrel 1 to sandwich the elastic member 3 between itself and the first mandrel 1.

A stationary guide 11 is fixed at the central portion of the first mandrel 1 to guide and hold both the first mandrel 1 thus arranged to extend along the upper face of the bed 15 and the pipe 16 born freely on the first mandrel 1. Thus, the stationary guide 11 prevents the pipe 16 and the first mandrel 1 from warping. In the vicinity of the end portion of the bed 15 at the side of the second mandrel 2, there are fixed on the bed 15 a pair of movable guide control cylinders 13, to which are attached movable guides 12. These movable guides 12 are made movable to clamp and fix the second mandrel 2 (and the pipe 16, if any) for preventing the warp of the second mandrel 2 acting for shaping the pipe 16 and to release the same from its (or their) clamped and fixed state.

Between the stationary guide 11 and the movable guide control cylinders 13, there is arranged a punch 4 which is so attached to a punch holder 4*a* as to move along the pipe born loosely on the first mandrel 1. The punch 4 thus arranged has a slightly larger internal diameter than the external diameter of the pipe 16.

To the end portion of the punch 4, there is fixed a cylindrical guide sleeve 4*g* which is arranged coaxially and has an internal diameter substantially equal to or slightly larger than the external diameter of a wrinkled pipe to be shaped. Into the punch holder 4*a*, there are screwed rods 17*a* and 17*b* which are guide by shaft guides 14*a* and 14*b*, respectively. The rods 17*a* and 17*b* are driven in parallel with the first mandrel 1 by punch driving cylinders 8*a* and 8*b*, respectively, so that the punch 4 may be moved along the pipe 16.

Between the punch 4 and the movable guide 12, there is interposed a chuck holder 5*a* which can be moved by a chuck feeding cylinder 10 along the pipe 16 borne loosely on the circumferences of the first and second mandrels 1 and 2. In the vicinity of the punch holder 4*a*, on the other hand, there is disposed a front stopper 19 for stopping the chuck holder 5*a*.

To the chuck holder 5*a*, there are attached a chuck 5 and a chuck inner block 5' which is assembled with the chuck 5. This chuck 5 and the chuck inner block 5' define inbetween a groove 6 which can have its width set to a desired value.

To the end portion of the chuck 5, moreover, there is fixed a cylindrical guide sleeve 5*g* which is axially arranged to have its inner circumferential wall abutting against the outer circumferential wall of the guide sleeve 4*g*.

By the actions of chuck control cylinders 9 fixed to the chuck holder 5*a*, moreover, the chuck 5 and the chick inner block 5' can be moved toward and apart from the pipe 16 borne loosely on the second mandrel 2.

The method of manufacturing a wrinkled pipe will be described in the following on the basis of the embodiment of the wrinkled pipe manufacturing apparatus having the structure thus far described according to the present invention.

FIGS. 3 to 11 are explanatory diagrams showing the individual steps of the manufacturing method according to the embodiment of the present invention.

Figure 3:
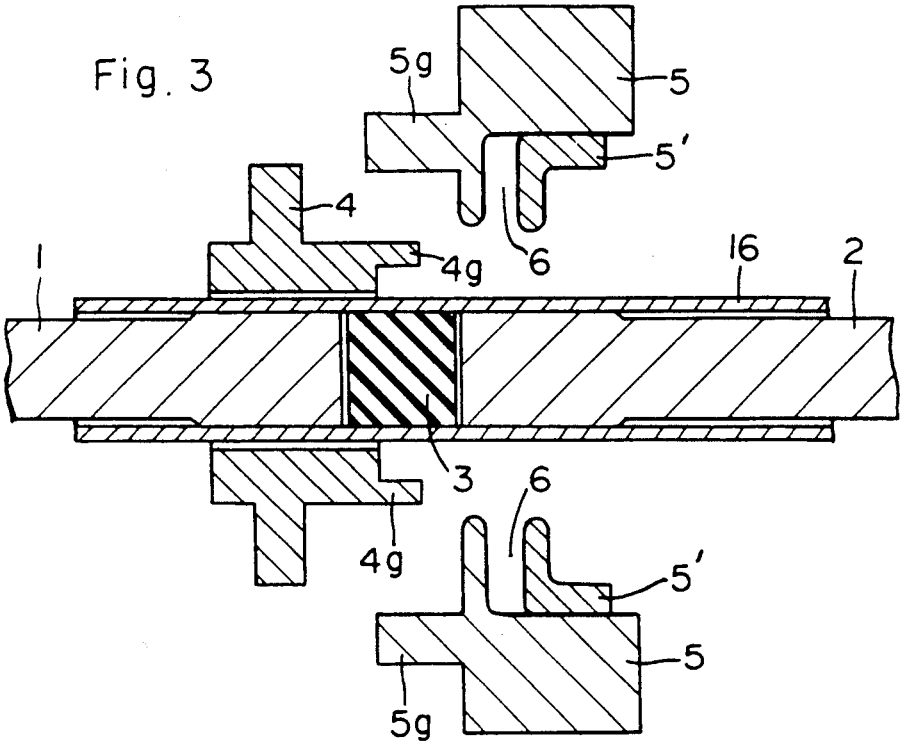
FIGS. 3 to 11 are explanatory diagrams showing the individual steps of the embodiment of the present invention.

FIG. 3 shows the step of loading the pipe 16 to be worked. This pipe 16 is loosely fitted on the first mandrel 1 attached to the not-shown bed, and the elastic member 3 is inserted into the pipe 16 till its one end face abuts against the leading end face of the first mandrel 1. Then, the second mandrel 2 is inserted into the pipe 16 to a position in which it clamps the elastic member 3 together with the first mandrel 1.

In this case, the chuck 5 and the chuck inner block 5' are preset to give a predetermined value to the width of the groove 6. Then, the chuck 5 and the chuck inner block 5' are positioned at a sufficient spacing from the pipe 16 by the actions of the chuck control cylinders 9, and the working end face of the chuck 5 is positioned in the vicinity of the boundary between the elastic member 3 and the second mandrel 2 by the action of the chuck feeding cylinder 10.

In this case, moreover, the movable guide control cylinders 13 of FIG. 1 are actuated so that the second mandrel 2 is so fixed with respect to the bed 15 by the movable guides 12 as may not warp in a subsequent shaping treatment.

Figure 4:
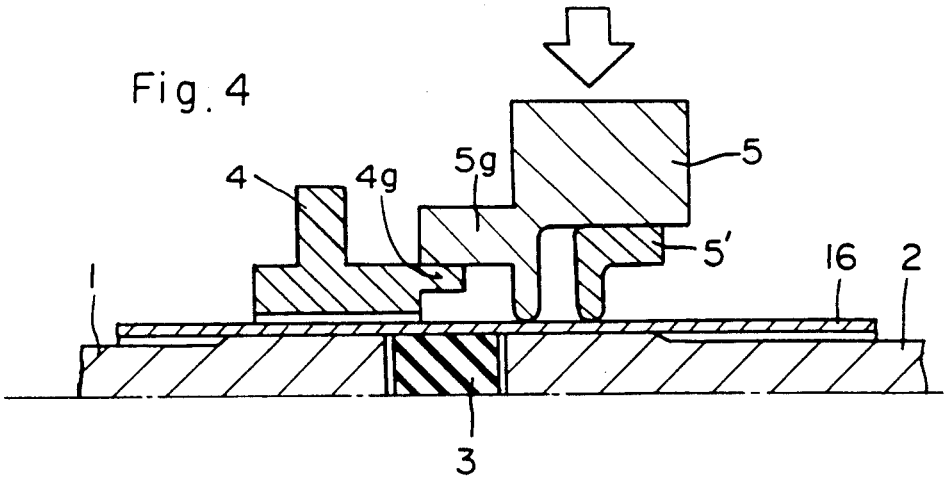

FIG. 4 shows the holding step by the chuck 5 and the chuck inner block 5'. The chuck control cylinders 9 are actuated to fix the leading ends of the chuck 5 and the chuck inner block 5' in contact with the outer circumference of the pipe 16.

At this time, the outer circumference of the guide sleeve 4*g* and the inner circumference of the guide sleeve 5*g* are in abutment contact with each other.

Figure 5:
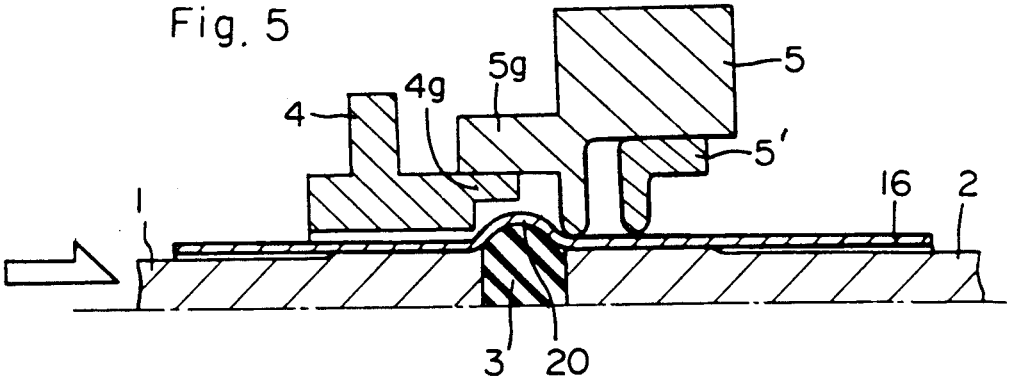
Figure 6:
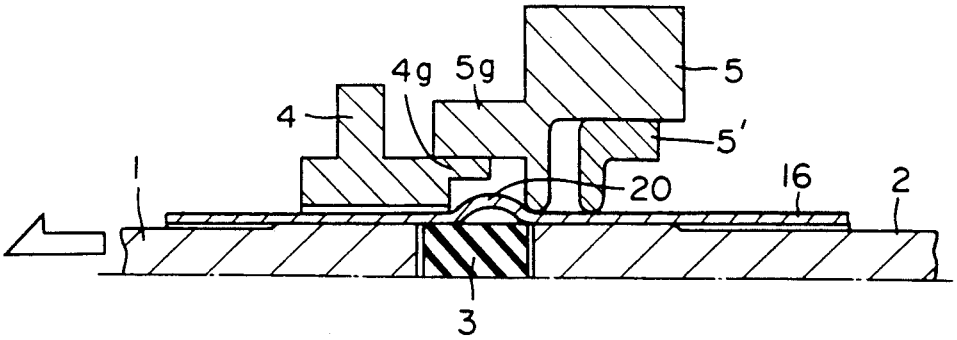

Next, at the annular bulging step, as shown in FIGS. 5 and 6, an annular bulge 20 is formed in the pipe 16. As shown in FIG. 5, the mandrel driving cylinder 7 is actuated, with the pipe 16 on the second mandrel 2 being fixed by the leading ends of the chuck 5 and the chuck inner block 5', to compress and bulge the elastic member 3 by the first mandrel 1 so that the pipe 16 is radially bulged to form the annular bulge 20.

At this time, the punch 4 is moved, while holding its concentricity highly accurately, such that the guide sleeve 4*g* and the guide sleeve 5*g* keep their circumferences abutting against the chuck 5 and the chuck inner block 5'.

After the first mandrel 1 has thus been moved a predetermined distance with respect to the elastic member 3 to form the annular bulge 20, the mandrel driving cylinder 7 is actuated, as shown in FIG. 6, to move the first mandrel 1 apart from the chuck holder 5*a* until it restores the original position to return the elastic member 3 to the original shape.

Figure 7A:
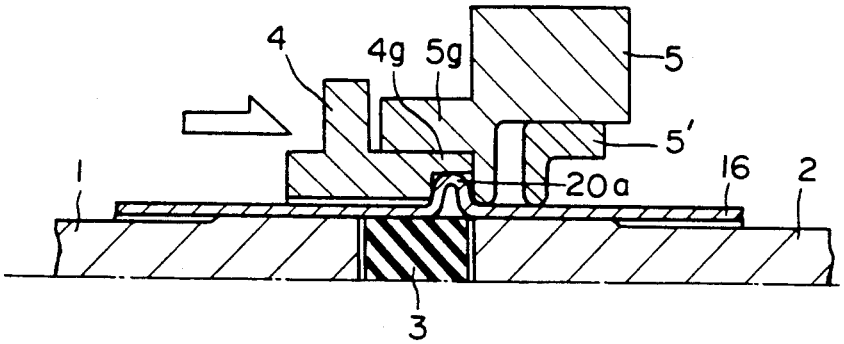
Figure 7B:
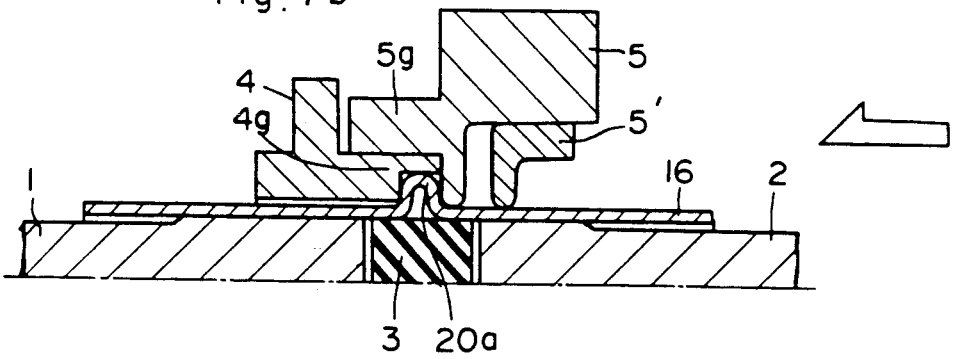
Figure 7C:
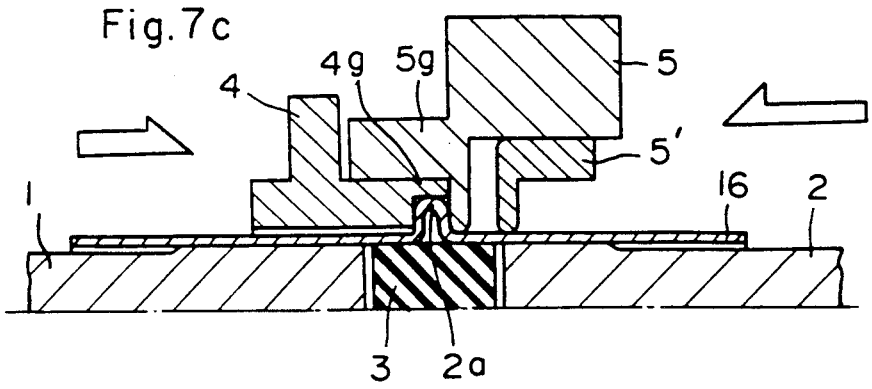
Figure 8:
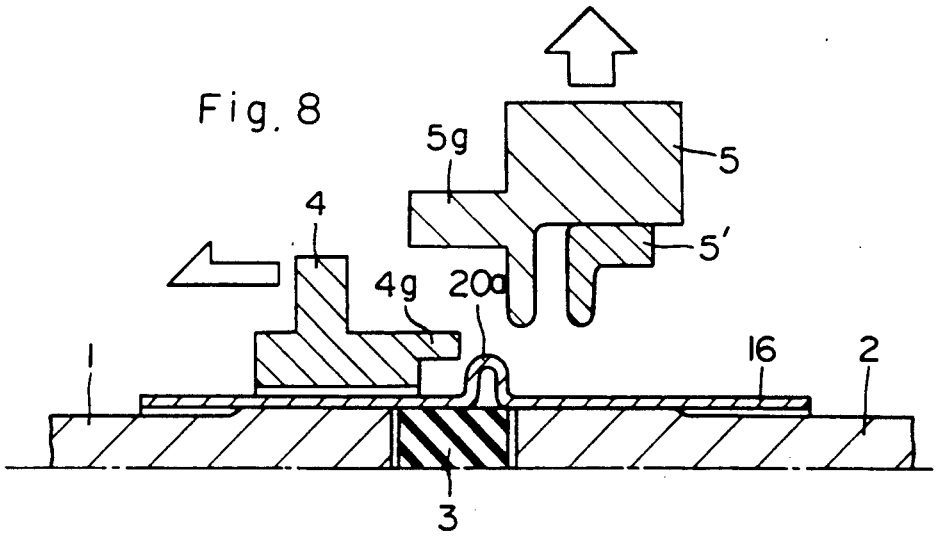

Next, the annular bulge 20 formed in the pipe 16 at the first step is shaped into a wrinkle 20*a* at a wrinkling (or second) step, as shown in FIGS. 7 and 8. As shown in FIG. 7, the punch driving cylinders 8*a* and 8*b* are actuated, with the pipe 16 on the second mandrel 2 being held by the chuck 5 and the chuck inner block 5', to move the punch 4 a predetermined distance toward the chuck holder 5*a* by the rods 17*a* and 17*b*. As a result, the annular bulge 20 is clamped and pushed between the opposed faces of the punch 4 and the chuck 5 to form the wrinkle 20*a*. At this time, this wrinkle 20*a* is shaped to have a width slightly smaller than the width of the groove 6 between the chuck 5 and the chuck inner block 5'.

Since, in this case, the guide sleeve 4*g* and the guide sleeve 5*g* have their circumferences abutting against each other, the concentricities of the punch 4, the chuck 5 and the chuck inner block 5' with respect to the axis are held highly accurate.

Since, moreover, the outer circumference of the wrinkled pipe to be shaped is pushed by the inner circumference of the guide sleeve 4*g*, the external diameter of the wrinkled pipe is pushed by the inner circumference of the guide sleeve 4*g*, its external diameter can be highly accurate. In case, moreover, a multi-layered pipe is to be wrinkled, it is freed from having its outermost layer separated at its end portion.

In this case, as shown in FIG. 7(*b*), the wrinkled pipe 20*a* can also be formed by holding the pipe 16 by the punch 4 and by moving the chuck 5 and the chuck inner block 5' toward the punch 4. As shown in FIG. 7(*c*), the wrinkled pipe 20*a* can be further formed by moving the punch 4, the chuck 5 and the chuck inner block 5' synchronously.

After the wrinkle 20*a* has been formed on the circumference of the pipe 16, the punch driving cylinders 8*a* and 8*b* are actuated to return the punch 4 to the original position, as shown in FIG. 8, and the chuck control cylinders 9 are actuated to move the chuck and the chuck inner block 5' apart from the pipe 16.

Figure 9:
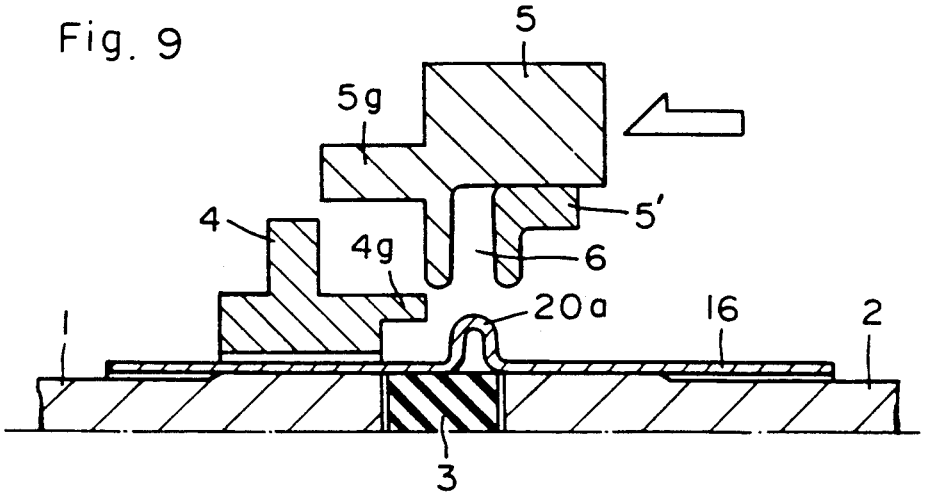
Figure 10:
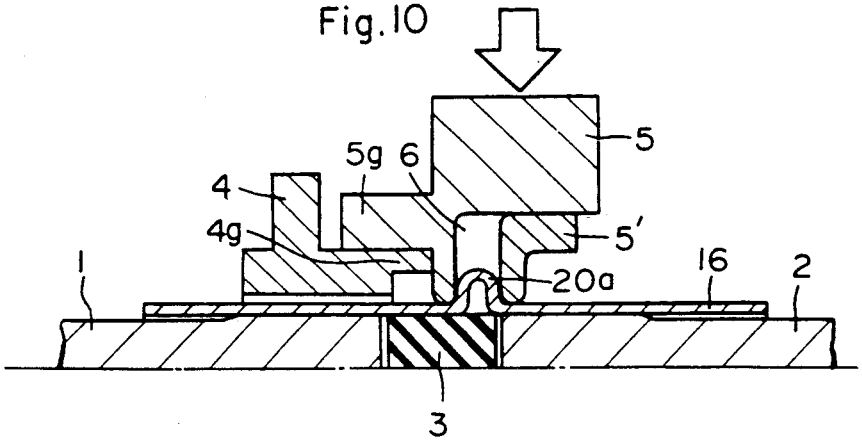
Figure 11:
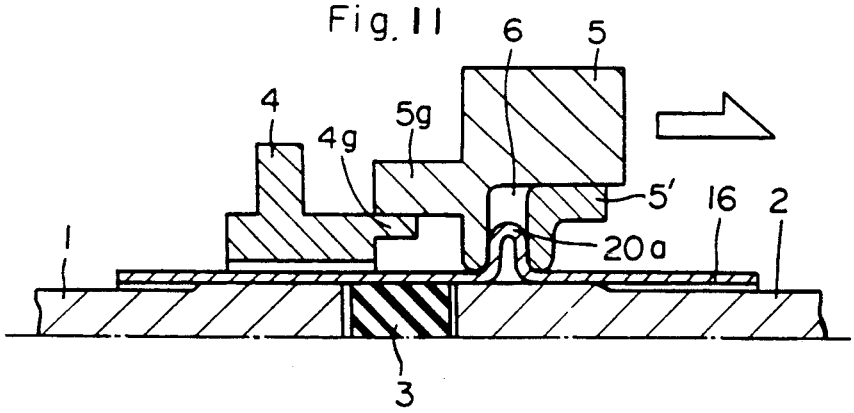

Next, the pipe 16 thus formed with the wrinkle 20*a* at the second step is moved at a moving (i.e., third) step, as shown in FIGS. 9 to 11, to a position in which it is to be formed with a subsequent wrinkle. As shown in FIG. 9, the chuck feeding cylinder 10 is actuated to move the guide sleeve 5*a* so that the groove 6 between the chuck 5 and the chuck inner block 5' may be brought to a position over the wrinkle 20*a* formed at the second step, to clamp the wrinkle 20*a*.

In this position, the chuck control cylinders 9 are actuated to bring the chuck 5 and the chuck inner block 5' to the vicinity of the pipe 16 so that the groove 6 may clamp the wrinkle 20*a*, as shown in FIG. 10. When the end portion of the pipe 16 having the wrinkle comes to the position of the movable guides, the movable guide control cylinders 13 are actuated to release the fastening of the second mandrel by the movable guides 12. Then, the chuck feeding cylinder 10 is actuated to move the chuck 5 and the chuck inner block 5' so that the end portion of the chuck 5 may come to the boundary of the elastic member 3 and second mandrel 2. In accordance with these movements, the pipe 16 is moved on the first mandrel 1 and the second mandrel 2. Incidentally, the movable guides 12 are forced into contact with the outer circumference of either the unworked portion or the wrinkle of the pipe 16 to prevent the second mandrel 2 and the pipe 16 from warping in a subsequent shaping operation.

At this third step, too, the chuck 5 and the chuck inner block 5' are moved with respect to the punch 4 with the guide sleeve 4*g* and the guide sleeve 5*g* having their circumferences facing each other, so that the concentricities with respect to the axis are held highly accurate during the movements.

Next, that portion of the pipe 6 between the punch 4 and the chuck 5, which is to be worked, is repeatedly subjected to the first to third steps to form another wrinkle adjacent to the winkle 20*a*. Similar steps are subsequently repeated to manufacture the wrinkled pipe from the pipe 16.

After the wrinkled pipe has been completed, the cylinders 13 are actuated to release the movable guides 12 so that the wrinkled pipe is taken out of the apparatus by removing the second mandrel 2.

In the embodiment of the present invention, the elastic member 3 is compressed by the first mandrel 1 and the second mandrel 2 by using the pipe 16 itself as a guide, so that the mandrels can be remarkably thinned. As a result, the pipe 16 and the mandrel 1 are borne and restrained from the warp by the stationary guide 11 and the movable guides 12 so that a wrinkled pipe having a small diameter of 16 mm or less can be manufactured. The apparatus of the present invention should not be limited to the manufacture of such thin wrinkled pipe but can naturally manufacture a wrinkled pipe of large diameter.

Since the punch 4, the chuck 5 and the chuck inner block 5' are moved in the axial direction with the guide sleeve 4*g* and the guide sleeve 5*g* being in abutment, the high concentricities can be held with respect to the axis to manufacture the wrinkled pipe which has the uniform wrinkles of high accuracy and ample resistance but not separation of the outer most layer end portion even if the pipe is multi-layered.

Since, moreover, the second mandrel 2 operates to have its end face substantially coextending with the end portion of the chuck 5, the elastic member 3 can be prevented from bulging into the chuck 5 and the chuck inner block 5' to reduce the shaping force of the chuck 5 and the chuck inner block 5' without preventing any breakage of the elastic member 3.

Since the pipe 16 is allowed to move freely at the side of the first mandrel 1, it can smoothly move at the first and second steps to suppress the reduction of the thickness remarkably. No slippage of the pipe 16 occurs from the elastic member so that the lifetime of the elastic member 3 is elongated.

Since, moreover, none of the punch 4, the chuck 5 and the chuck inner block 5' has any groove for regulating the wrinkles, the external diameter or pitch of the wrinkles can be set at will by adjusting the size between the punch 4 and the chuck 5 and the stroke of the punch 4, while keeping the elastic member away from biting into the gap of the wrinkles 2 even if the wrinkles are to be continuously shaped.

Since the wrinkled pipe 20*a* can be manufactured to have its external diameter regulated highly accurately, the curling end portion would not rise even if the wrinkled pipe were manufactured from a cylinder made of a curled thin metal sheet.

Figure 12:
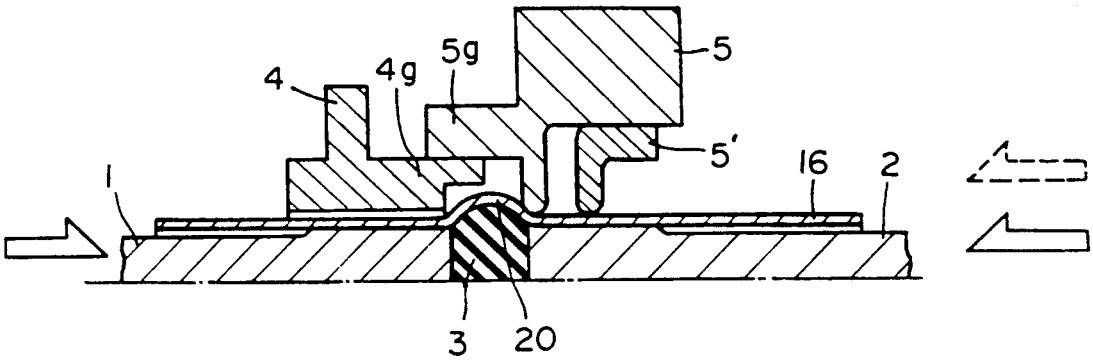
FIGS. 12 to 14 are explanatory diagrams showing the steps of other embodiments of the present invention.

Incidentally, the embodiment has been described in connection with the apparatus for manufacturing the wrinkled pipe by moving the first mandrel while leaving the second mandrel stationary. Despite of this description, however, the present invention should not be limited to that embodiment but can be applied to a variety of apparatus for manufacturing a wrinkled pipe. As indicated by an arrow of broken lines in FIG. 12, for example, the apparatus can be constructed to have a movable second mandrel and a stationary first mandrel. As indicated by an arrow of solid lines in the same Figure, on the other hand, the first and second mandrels can be moved in synchronism with each other.

Figure 13:
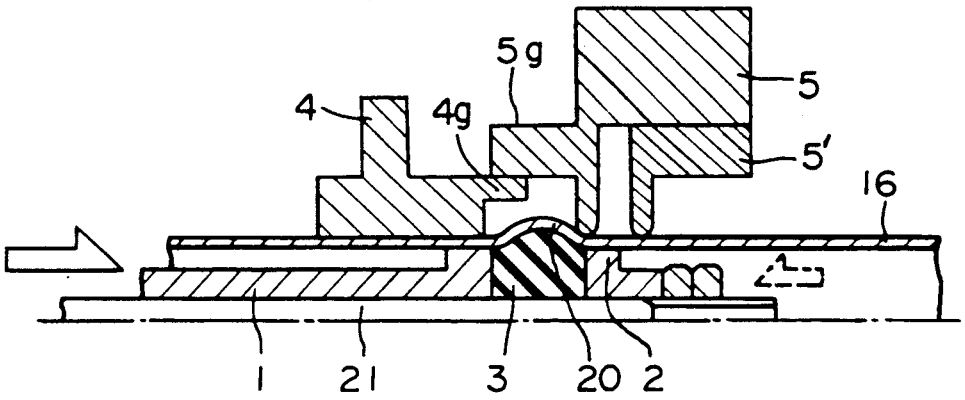

As shown in FIG. 13, moreover, the first mandrel 1 can be made hollow to receive a core 21, and the second mandrel 2 can be fixed to one end of the core 21. Then, the first mandrel 1 is pushed in the direction of an arrow of solid lines, and the second mandrel 2 is stopped in position by fixing the core 21 to bulge the intervening elastic member 3. With the first mandrel 1 being fixed, on the contrary, the second mandrel 2 is moved, as indicated by an arrow of broken lines, by pulling the core 21 so that the elastic member 3 may be bulged.

In the embodiment, on the other hand, the actuators for driving the movable mandrel, the punch, the chuck and the chuck inner block are exemplified by the cylinders. Despite of this fact, however, the present invention should not be limited to that embodiment but can be modified such that those elements are driven by pulleys to which the revolutions of a motor are transmitted through cams or belts.

Moreover, the bed can be equipped with a jig for determining the inserting position of the pipe to be worked, although the embodiment has failed to have the jig. Then, desired numbers of stationary guides and movable guides can be provided according to the lengths of the movable mandrel and the stationary mandrel.

Figure 14:
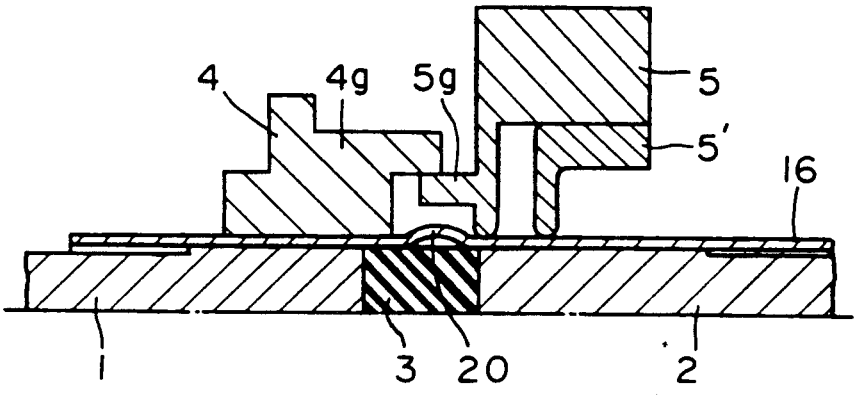

On the other hand, the embodiment thus far described is directed to the structure in which the guide sleeve of the punch constitutes the inner sleeve whereas the guide sleeve of the chuck constitutes the outer sleeve. As shown in FIG. 14, however, the structure can be modified such that the guide sleeve of the punch constitutes the outer sleeve whereas the guide sleeve of the chuck constitutes the inner sleeve.

As has been described in detail hereinbefore, according to the present invention, it is possible to provide an apparatus which is enabled to manufacture a wrinkled pipe highly accurately, no matter whether the pipe might have a large diameter or a remarkably small diameter, and a wrinkled pipe of multiple layers with high productivity without separation of the outermost layer end portion by minimizing the reduction in the thickness of the pipe being worked and by setting a variety of wrinkle shapes easily while avoiding the damage of the elastic member.

What is claimed is:

1. A wrinkled pipe manufacturing apparatus in which an elastic member is inserted into a pipe to be worked and is pushed from at least one side so that it may be radially bulged to form an annular bulge on the circumference of said pipe and in which a punch and a chuck disposed around the circumference of said pipe are axially moved relative to each other to form an annular wrinkle from said annular bulge, the annular wrinkle defining an external diameter and an axial length, wherein the improvement comprising:

first and second mandrels held over a bed to move freely in axial directions along an upper face of said bed, said mandrels having outer circumferences dimensioned to be inserted into the pipe for supporting the pipe;

first drive means for driving said mandrels in said axial directions;

an elastic member arranged in said pipe and between opposed leading end faces of said first and second mandrels;

second drive means for moving at least one of the punch and the chuck toward one another; and a chuck guide sleeve and a punch guide sleeve projecting axially toward one another from the chuck and the punch respectively, the punch guide sleeve defining an internal diameter substantially equal to the external diameter of the annular wrinkle to be formed and defining an axial length substantially equal to the axial length of the annular wrinkle to be formed for controlling said external diameter and axial length of each wrinkle to be formed, the punch guide sleeve further having an external surface defining an external diameter, the chuck guide sleeve having an internal surface defining an internal diameter substantially equal to the external diameter of the punch guide sleeve, the internal surface of the chuck guide sleeve and the external surface of the punch guide sleeve being in abutting sliding relationship with one another for accurately guiding said chuck and said punch in said axial directions.

* * * * *